United States Patent [19]

Takahashi

[11] Patent Number: 4,742,372

[45] Date of Patent: May 3, 1988

[54] TONER DETECTION METHOD AND DEVICE FOR COPYING MACHINES

[75] Inventor: Masanobu Takahashi, Suita, Japan

[73] Assignee: Mita Industrial Co., Ltd., Japan

[21] Appl. No.: 894,134

[22] Filed: Aug. 7, 1986

[30] Foreign Application Priority Data

Aug. 9, 1985 [JP] Japan ..... 60-176355
Aug. 9, 1985 [JP] Japan ..... 60-176356

[51] Int. Cl.[4] ..... G03G 13/06; G03G 15/06

[52] U.S. Cl. ..... 355/14 D; 355/3 DD; 355/4; 118/665; 118/689

[58] Field of Search ..... 355/14 D, 3 DD, 4; 118/665, 688, 689, 691

[56] References Cited

U.S. PATENT DOCUMENTS 4,519,695 5/1985 Murai et al. ..... 355/14 D
4,522,481 6/1985 Imai et al. ..... 355/14 D
4,551,005 11/1985 Koichi ..... 355/14 D
4,572,654 2/1986 Murai et al. ..... 355/14 D

*Primary Examiner*—R. L. Moses
*Attorney, Agent, or Firm*—Beveridge, DeGrandi & Weilacher

[57] ABSTRACT

A toner density control method applicable after detection of a toner empty condition. After each copying operation, in copying machines, a simulated original is exposed to produce a corresponding electrostatic latent image, which image is developed periodically to provide a toner image for detection of the toner image density. If a toner empty condition is detected, a toner density level lower than normal is compared with the detected toner density and then the normal toner density level is compared with the detected level. A toner density control device for forming copies having different colors is likewise disclosed. The optimum density data for development are preset according to the color of the toner contained in the developing device. Electrostatic latent images are developed and compared with the detected density level of the toner image so that a relative decrease in toner image density can be compensated by driving the toner supply device.

7 Claims, 6 Drawing Sheets

TONER DETECTION METHOD AND DEVICE FOR COPYING MACHINES

BACKGROUND OF THE INVENTION

The present invention relates to a method and a device for controlling the toner density in copying machines. According to the detection method a toner image corresponding to a simulated original is formed, and the detected density thereof is compared with a reference value. The toner density control device for copying machines maintains optimum toner density regardless of toner color if the copying machine provides colored copies.

There is a known control device for toner density for copying machines (Japanese Laid-Open patent Publication No. 128977/1981) in which a simulated original is attached at a predetermined position away from the setting zone of the original which is on a contact glass, and a toner image corresponding to the simulated original is formed on a photoreceptor drum after each copying operation. The detected density of the toner image then is compared with a reference level to drive a toner supply mechanism, if necessary, according to the comparison result to maintain optimum toner density.

In the aforementioned copying machine, the toner image density corresponding to the simulated original is detected after each copying operation, therefore, the image density can be maintained at a predetermined level according to the detection result. However, it is necessary to form a toner image of the simulated original for each copying operation. Furthermore, the toner used for forming this toner image is removed by a cleaning blade after the density detection, and thus more than the amount of toner necessary to provide copies of the original is consumed and also the cleaning ability of the cleaning blade is partially decreased.

It may be possible to solve the above inconveniences by the step of developing an electrostatic latent image directly to provide a toner image and another step of making the latent image disappear without developing a toner image, which steps are carried out periodically and selectively to reduce the frequency of toner image density detection. In this approach, a toner empty condition affects the density detection of the toner image thereafter, whereby density detection is not carried out for each copying operation, and toner corresponding to the original is consumed for each copying action during which no detecting is carried out, resulting in an earlier empty toner condition. Even if the toner empty condition was detected and toner was supplied accordingly, delayed detection of the density recovery again causes detection of an empty condition which results in halting operation of the copying machine to prevent degradation of the developing agent due to continued copying operations during a toner empty condition. The aforementioned problem becomes particularly significant if an original with a dominant dark portion is to be copied.

Another copying machine is known in which two developing devices are located near a photoreceptor drum and a different colored toner is stocked in each developing device. Operation is controlled to provide copies having the desired color. For developing electrostatic latent images formed on the photoreceptor drum by controlling the toner density in such copying machines, each developing device is provided with a contant feed device consisting of solenoids, one-way mechanisms, etc., a detection device for detecting toner density consisting of level sensors, coil inductors etc., and a toner supply device driven according to toner density detection signals.

In the aforementioned conventional copying machine, the two developing devices have different dimensions to accommodate different frequencies of use, etc.

Therefore, the attachment of such a control device with level sensors for the toner supply often may be difficult in a smaller developing device, even if possible in a larger one, and consequently a constant feed device with solenoids, one-way mechanisms, or the like is used.

As a result, if copying is carried out with a larger developing device, it is possible to obtain high-quality copies through precise density controls corresponding to various originals, but the precise density control is not achievable for copying with a smaller developing device and this results in degradation of the quality of the copies so obtained.

SUMMARY OF THE INVENTION

An object of this invention is to reduce toner consumption and to assure effective detection of toner density.

Another object of this invention is to assure precise detection of toner density when a toner empty condition is detected after which toner should be supplied.

A further object of this invention is to assure precise control of toner density matched with various originals, regardless of the type of developing device used so that high-quality copies are obtained.

A still further object of this invention is to obtain high-quality copies through precise control of the toner density matched with various originals when the toner color is changed by exchanging developing devices.

In the toner concentration detection method according to the present invention, a simulated original is exposed after each copying operation in order to produce an electrostatic latent image thereof. A step of developing the electrostatic latent image into a toner image and another step of causing the electrostatic latent image to disappear before the development thereof are repeated alternately at a predetermined interval. The density of the toner image corresponding to the simulated original is detected. If a predetermined number of copying cycles is to be carried out after detection of an empty toner condition, a level corresponding to a toner density lower than normal is compared with the detected level of toner density, while a level corresponding to normal toner density is compared with the detected toner density level for the remaining copying operations.

According to the aformentioned toner density detection method, the electrostatic latent image corresponding to the simulated original is developed to provide a toner image, the density of which is detected, and further the reference value for the toner density detection is adjusted to a density level lower than normal for a predetermined number of copying cycles after detection of an empty toner condition so that the toner density can be detected in accordance with recovery of toner density. For the remaining copying operations, the reference value is adjusted to a level corresponding to normal toner density so that toner density can be detected at a recovered condition.

Meanwhile, the toner density control device according to this invention includes a color recognition means, an output means for providing a reference value, a toner density detection means and a control means.

The aforementioned color recognition means recognizes the color of the toner contained in a developing device. Data corresponding to optimal development corresponding to a particular toner color are preset by the aforementioned reference value output means. The aforementioned toner density detection means detects the toner density, and the aforementioned control means generates signals for driving the toner feed device in response to the output signals from the detection means and the reference value output means, which signals are provided as input signals to the control means.

According to the invention, only one developing device need be assigned to the photoreceptor, whereby a separate developing device containing different color toner, or more than two developing devices containing toner of more colors may be provided for selective application. Preferably, the aforementioned color recognition means comprises magnets and reed switches.

According to the toner density control device of the present invention, the color of the toner contained in the developing device is recognized by the color recognition means. An electrostatic latent image formed on the surface of the photoreceptor is developed into a toner image, the density of which is detected by the toner density detection means. Reference value signals corresponding to the particular toner color from the reference value output means and detection signals from the toner density detection means are then supplied to the control means. The control means judges whether more toner should be supplied or not and provides driving signals corresponding to this judgement or determination to the toner feed device to thereby control the copy density at an optimum level.

The above objectives similarly can be achieved with the attachment of only one exchangeable developing device or alternatively, with more than two developing devices.

Moreover, the color recognition means, implemented simply with magnets and reed switches, can identify the color of the toner to be used.

Furthermore, it is preferred that the electrostatic latent images corresponding to the simulated original located at a predetermined position outside of the exposure zone of the original to be developed to provide a toner image for density detection.

DESCRIPTION OF THE PREFERRED EMBODIMENTS

Figure 4:
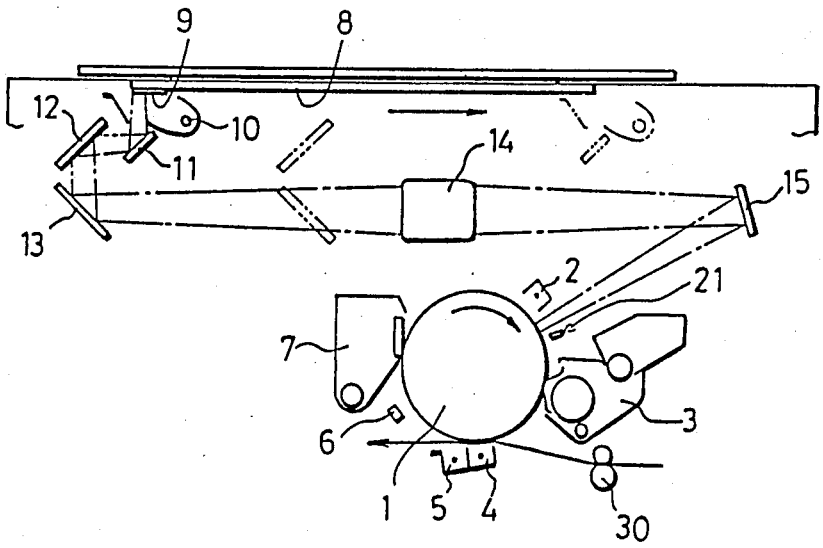
FIG. 4 is a partial diagrammatic side view showing the main parts of a copying machine.

In FIG. 4 a copying machine is shown to include a corona charger (2), a blank lamp (21), a developing device (3), a transfer charger (4), a separation charger (5), a reflection type sensor (6) for detecting the toner density and a cleaner (7) located proximal to a photoreceptor drum (1), around the periphery thereof.

Moreover, the copying machine includes a contact glass (8), on which an original should be positioned. A simulated original (9) is located at a predetermined home position apart from the exposure zone for the original. An optical system comprising a light source (10), reflecting mirrors (11), (12), (13), a lens (14) and another reflecting mirror (15) is provided between the contact glass (8) and the photoreceptor drum (1).

When the light source (10) and the reflecting mirror (11) are moved at a predetermined speed while the reflecting mirrors (12) and (13) are moved at one-half that speed, the original set on the contact glass (8) is illuminated and the reflected light therefrom is directed to the photoreceptor drum (1).

The aforementioned photoreceptor drum (1) rotates in a predetermined direction, while the following are performed in succession: charging by the corona charger (2), formation of electrostatic latent images by light reflected from the original and directed through the aforementioned optical system, development of the electrostatic latent image to provide a toner image by the developing device (3), transfer of the toner image onto a copying paper by the transfer charger (4), peeling of the copying paper by the separation charger (5) from the photoreceptor drum (1), toner image density detection by the reflection type sensor (6), and recovery of the remaining toner by the cleaner (7).

An electrostatic latent image corresponding to the simulated original (9) may be produced every time on the photoreceptor drum (1), however, the illumination of the blank lamp (21) is controlled in such manner that, for instance, the image is actually developed only once during a predetermined number of cycles to provide a toner image and blanked during all other copying cycles.

Figure 1:
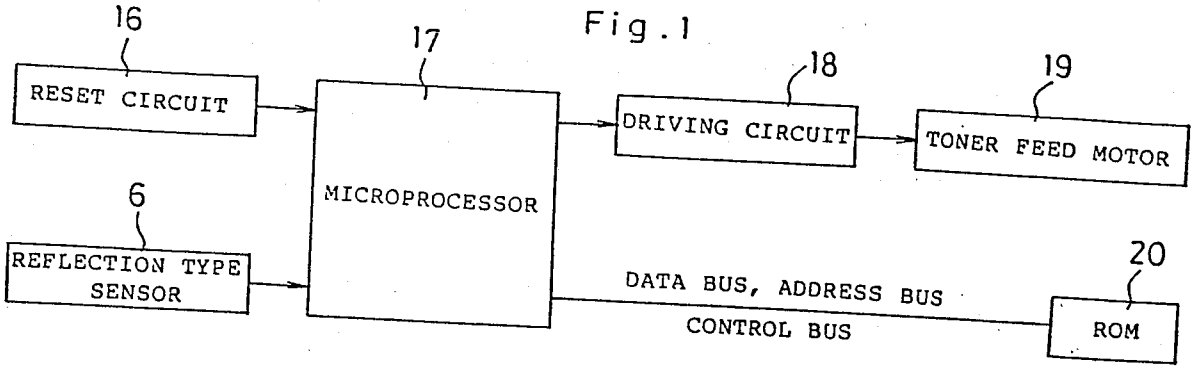
FIG. 1 is a block diagram of a portion of the toner density controller according to the present invention.

In FIG. 1, showing the block diagram of the density control device, reset signals from the reset circuit (16) and output signals from the reflection type sensor (6) are provided to the microprocessor (17) through an analog-digital converter, I/o port and the like (not shown), while driving signals for the toner feed device (not shown) from the microprocessor (17) are provided through an I/o port, a digital-analog converter, and the like (not shown) to the driving circuit (18), the output signals from which are provided to the toner feed motor (19). ROM (20) is connected with the aforementioned microprocessor (17) through a data bus, address bus and a control bus.

Figure 2:
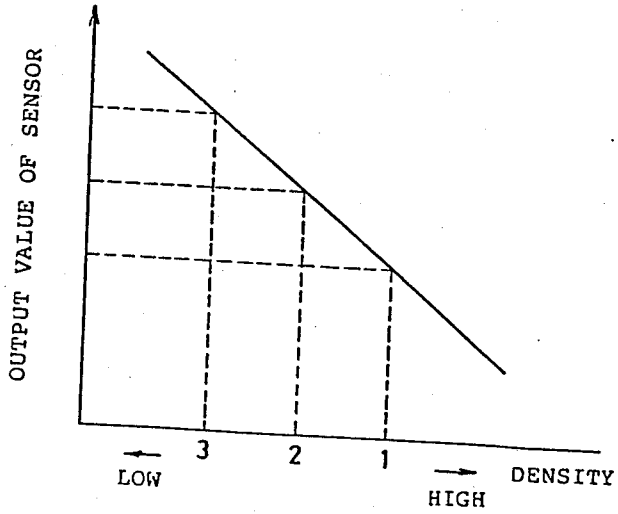
FIG. 2 is a diagram useful in understanding the relation between the toner density and the sensor output value for the device of FIG. 1.

As shown in FIG. 2, the data stored in the aforementioned ROM (20) comprise the output values (referred to as 1 in Fig. 2) from the reflection type sensor (6) which correspond to the optimum toner density, the output values (referred to as 2 in FIG. 2) of the reflection type sensor (6) which correspond to the normal toner empty level and the output values (referred to as 3 in FIG. 2) of the reflection type sensor (6) which correspond to the empty level, modified immediately after a supply of toner.

The only function expected for the aforementioned reset circuit (16) is to provide reset signals, for example, when the copying machine is reset. Therefore, a reset switch capable of operating automatically according to the opening and/or closing of the front cover (not shown) of the copying machine suffices as the reset circuit.

Figure 3:
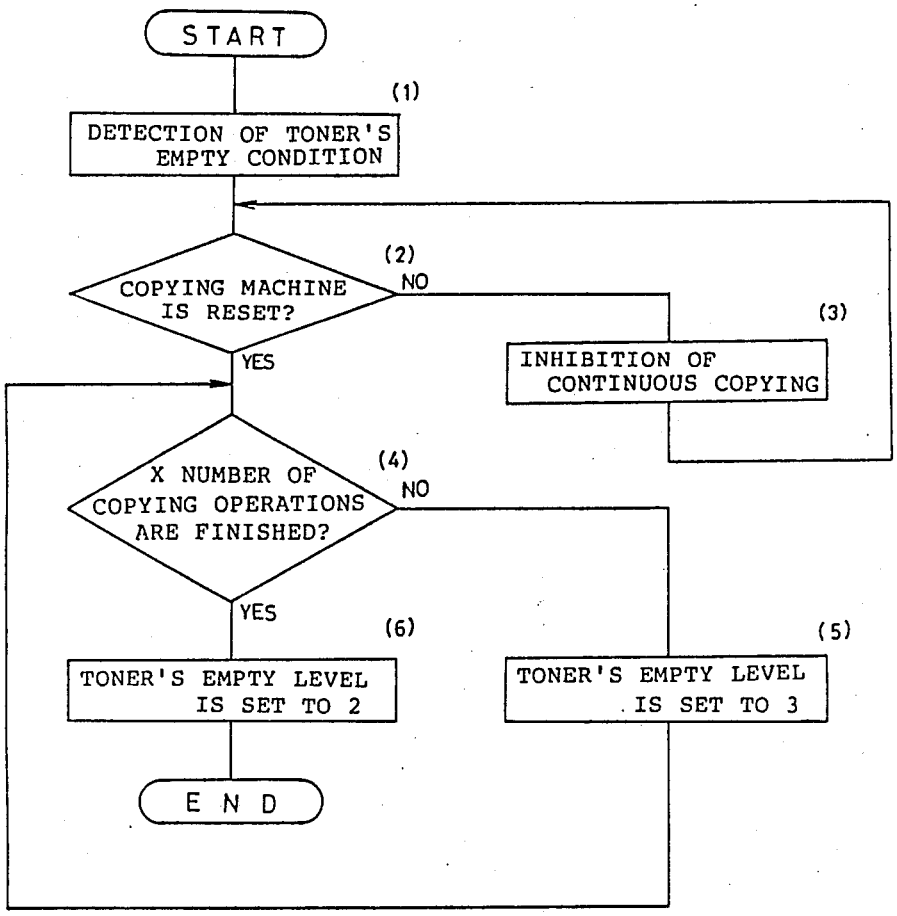
FIG. 3 is a flow chart for a density detecting procedure according to the embodiment of FIG. 1.

FIG. 3 is a flow chart illustrating the toner density detecting procedure according to the invention. When an empty condition is detected in step (1), it is judged in step (2) whether the copying machine has been reset or not by the presence or absence of reset signals, i.e. whether the toner refilling from the toner cartridge or others is carried out or not.

If it is judged that the copying machine has not been reset, continuous copying (to obtain a plurality of copies) is inhibited in step (3) and at the same time the toner empty condition is displayed to restart the judgement in step (2).

On the other hand, if it is judged that the copying machine was reset, in step (4) it is judged whether a certain number x of copying operations were performed after the machine was reset.

The toner empty level is set to a level 3 (FIG. 2) in step (5) when the copying operation signal is output in step (4) and the latter level is maintained until X copying operations are completed. When it is judged that more than X copying operations were completed in step (4), the toner empty level is set in step (6) to a level 2 in FIG. 2, which is maintained until the toner empty condition is detected in step (1).

In summary, continuous copying is inhibited during the time interval from the detection of a toner empty condition to resetting of the copying machine in order to avoid any degradation of the developing agent. After the copying machine is reset, the toner empty condition is judged with respect to a reference level higher than the normal toner empty level until the predetermined number of copying operations is finished and then judged with respect to the normal toner empty level after performance of the predetermined number of copying operations so that the toner empty condition can be detected exactly, regardless of the time lapse after the toner supply.

Therefore, the empty condition can be detected exactly notwithstanding the decreased detection number of toner density, while toner consumption can be reduced by reducing the detection number of toner density.

Figure 9:
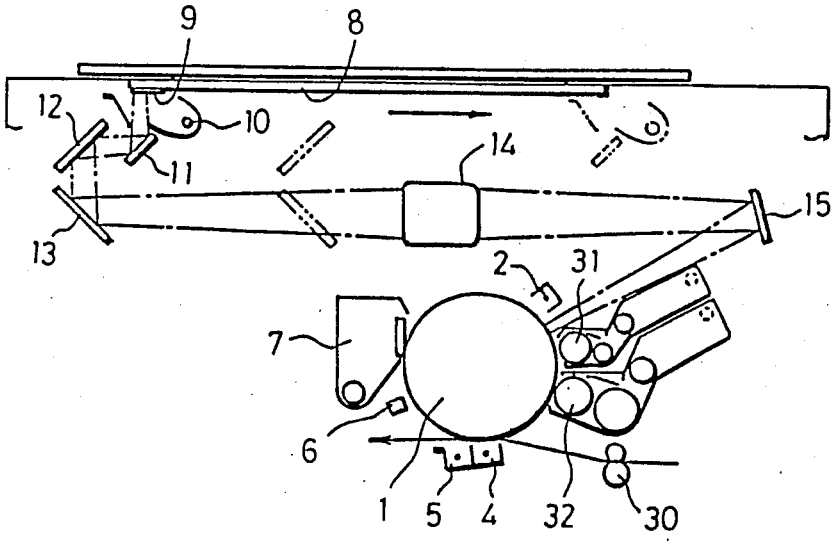
FIG. 9 is a partial diagrammatic side view, similar to FIG. 4, showing the main parts of a copying machine.

FIG. 9 shows another copying machine wherein a sub-developing device and the main developing device (32) are provided instead of the aforementioned developing device (3) in FIG. 4.

Therefore, it is possible to illuminate the original set on the contact glass (8) and to transmit the reflected light from the original onto the photoreceptor drum (1) by moving the light source (10) and the reflecting mirror (11) at a predetermined speed and by moving the reflecting mirrors (12), (13) at half that speed.

Moreover, the aforementioned photorector drum (1) is rotated constantly in a predetermined direction to successively actuate: electrostatic charging by the corona charger (2), formation of an electrostatic latent image by light reflected from the original and directed through the aforementioned optical system, development of the electrostatic latent image to provide a toner image in any one of the developing devices, transfer of the toner image onto a copying paper by the transfer charger (4), peeling of the copying paper by the separation charger (5), detection of toner density by the reflection type sensor (6), and recovery of remaining toner by the cleaner (7).

Moreover, a resist roller (30) is provided for transferring the copying paper in synchronization with the electrostatic latent image formed on the photoreceptor drum (1).

Figure 8:
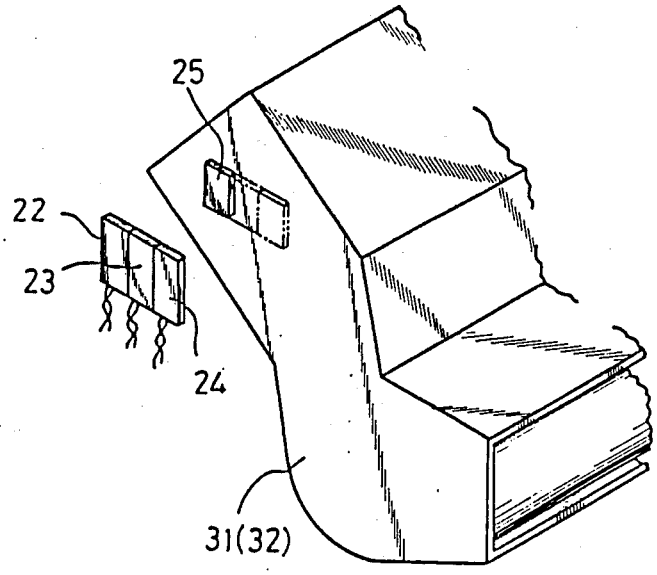
FIG. 8 is a perspective view showing the main elements of a color recognition means according to the embodiment of FIG. 5.

In FIG. 8, showing a perspective view of the color judgement portion, three reed switches (22), (23), (24) are located at predetermined positions on the copying machine body, while a magnet (25) is attached at a predetermined position in the developing device body in opposition to any one of the aforementioned reed switches. The relative position of the magnet (25) and the reed switches (22), (23) and (24) indicates the color of the toner contained, which thus can be judged according to output signals provided by the reed switches (22), (23) and (24).

Figure 5:
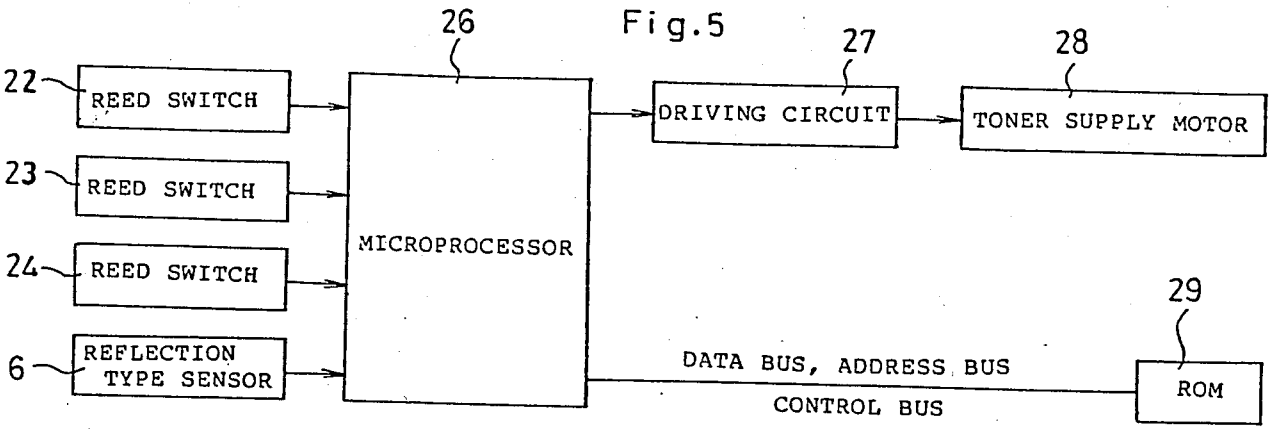
FIG. 5 is a block diagram of another density control device according to the present invention.

FIG. 5 is a block diagram of the density control device of the copying machine in FIG. 9 wherein the outputs from the reed switches (22), (23), (24) and the reflection type sensor (6) are connected to the microprocessor (26) through an analog-digital converter, I/o ports and like elements (not shown), while the driving signals of the toner supply device (not shown) from the microprocessor (26) are supplied through I/O ports, a digital-analog converter and like elements (not shown) to the driving circuit (27), the output signals from which are provided to the toner supply motor (28) to drive the toner supply device (not shown). Moreover, a ROM (29) acts as a reference value output means. The ROM is connected to the aforementioned microprocessor (26) over a data bus, address bus and a control bus.

Figure 6:
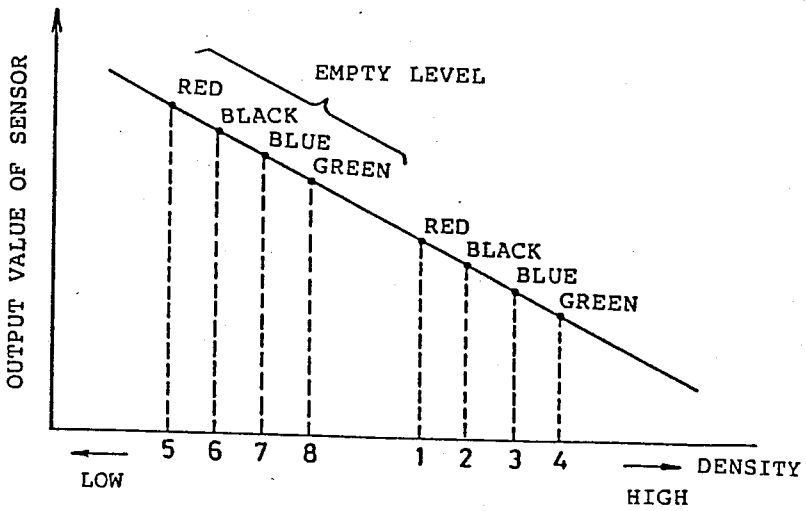
FIG. 6 is a diagram useful in understanding the relation between the density and the sensor output value for the device of FIG. 5.

The data stored in the aforementioned ROM (29) comprise, as illustrated in FIG. 6, output values from the reflection type sensor (6) that correspond to the optimum density of each toner color and output values therefrom corresponding to a toner empty level for each toner color.

Figure 7:
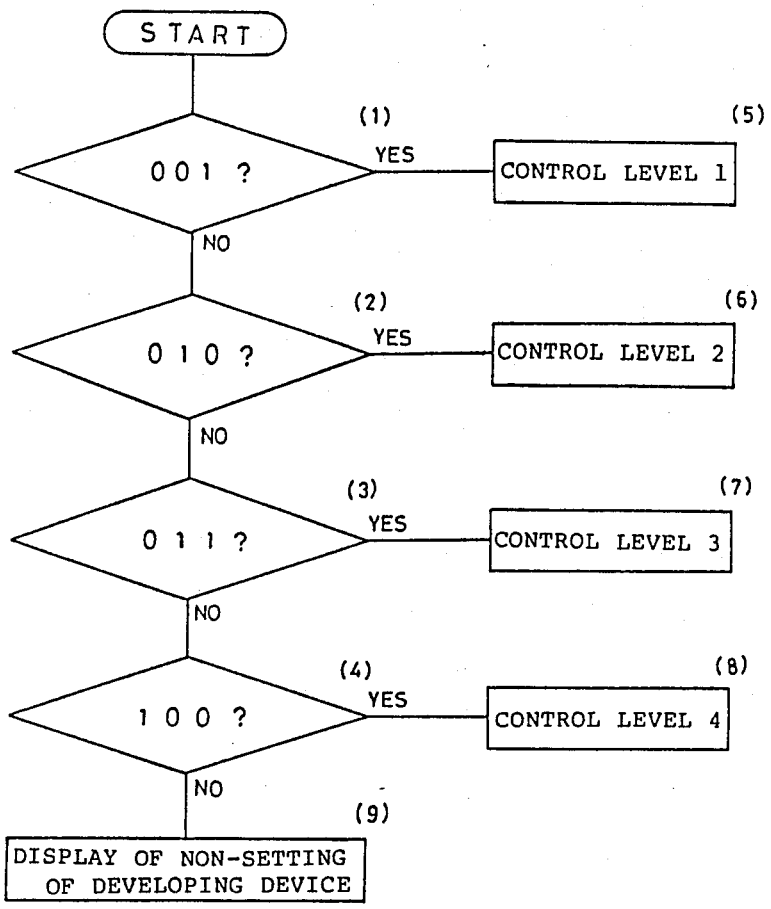
FIG. 7 is a flow chart for the density control procedures according to the embodiment of FIG. 5.

FIG. 7 is a flow chart illustrating operation of the density control device according to the present invention, wherein it is judged in steps (1) through (4) whether the status of the aforementioned reed switches (22), (23), (24) is 001, 010, 011 or 100 (Provided that the state of the reed switch in opposition to the magnet is represented as 1, while the states of the reed switches not opposing the magnet are represented as 0 respectively) or not. The states; 001, 010, 011 and 100 respectively correspond to red, black, blue and green toner color. If any one of the aforementioned states is judged, at any step from (5) to (8) the reference value 1, 2, 3, or 4, corresponding to each toner color in FIG. 6, is read out from the ROM (29) as the output therefrom and compared with the detection signals from the reflection type sensor (6). The driving device (27) then drives the toner supply motor (28) according to the comparison signals so that copy density is maintained at the optimum value. If it is judged that there is no response to any one of the states (the status 000), no setting of the developing device is displayed in step (9).

Though not shown in the aforementioned flow chart, it is possible to display a toner supply command effected through an exterior operation when a toner empty level 5, 6, 7, or 8 in FIG. 6 equals the detection signals from the reflection type sensor (6).

In the above copying machine, a key (not shown) is used to select one of the developing devices (the sub-developing device (31) or the main developing device (32)).

In summary, the toner color is detected by the states of the reed switches (22), (23), (24) and the reference value is changed according to the toner color detected to control the copy density at the optimum value, regardless of the toner color.

The toner supply in the developing device can be controlled in accordance with the color of the toner stocked in the developing device to provide appropriate copies, regardless of the toner color.

It should be clearly understood that this invention is not limited to the aforementioned embodiments. For example, the copying machine may have a construction which allows setting only one developing device, which can be exchanged, if required, with another developing device containing toner with different color or another construction which allows setting of two developing devices at the same time, wherein one or both of such developing devices are exchangeable. Thus other modifications are allowable without alteration of the spirit of this invention, which thus remain within the scope of this invention.

I claim:

1. A method for detecting toner density in developed images in a copying machine, said method comprising the steps of:

providing a simulated original at an exposable position remote from an original exposure zone of the copying machine;

exposing the simulated original to produce an electrostatic latent image thereof;

developing the electrostatic latent image of the simulated original to provide a developed image at a predetermined interval of copying cycles and blanking the latent image before development thereof during other copying cycles;

detecting the toner image density for the developed image to obtain an image density detection value;

detecting a toner empty condition;

comparing the image density detection value with a value less than a normal value for a selected number of copying operations, and comparing the detection value with a value equal to the normal density value for copying operations exceeding the selected number.

2. A device for controlling developed image density in copying machines provided with a developing device, positioned near a photoreceptor, for forming a developed toner image from an electrostatic latent image correponding to an original image formed on the photoreceptor, said device comprising:

a color recognitio means for identifying the color of toner contained in the developing device and providing output signals indicative thereof, means for storing optimum development density data according to toner color and providing output signals indicative of the data, a density detection means for detecting the density of the toner image, and a control means for generating driving signals to control a toner supply device in response to the output signals from the density detection means and the means for storing optimum development density data to maintain optimum toner density regardless of toner color.

3. The device according to claim 2, wherein the density detection means detects the density of a toner image of a simulated original positioned in an exposure zone remote from an exposure zone of the original.

4. The device according to claim 2, wherein two developing devices are individually selectively attachable to the photoreceptor, each developing deivce containing toner having a different color.

5. The device according to claim 4, wherein the color recognition means comprises magnets and reed switches.

6. The device according to claim 2, wherein the photoreceptor is provided with more than two developing devices, each developing device containing toner having a different color and being selectively operable.

7. The device according to claim 6, wherein the color recognition means comprises magnets and reed switches.

* * * * *